United States Patent [19]

Kodama

[11] Patent Number: 4,635,920

[45] Date of Patent: Jan. 13, 1987

[54] SELECTIVE SHEET LOADING APPARATUS

[75] Inventor: Yutaka Kodama, Tokyo, Japan

[73] Assignee: Ricoh Company, Ltd., Japan

[21] Appl. No.: 757,625

[22] Filed: Jul. 22, 1985

[30] Foreign Application Priority Data

Jul. 20, 1984 [JP] Japan ..... 59-149678
Aug. 10, 1984 [JP] Japan ..... 59-168679

[51] Int. Cl.[4] ..... B65H 29/14; B65H 33/06

[52] U.S. Cl. ..... 271/81; 271/184; 271/225; 271/272; 271/265

[58] Field of Search ..... 271/314, 207, 81, 225, 271/298, 272, 299, 265, 184, 176; 414/54, 90

[56] References Cited

U.S. PATENT DOCUMENTS

| | | | |
|---|---|---|---|
| 2,939,202 | 6/1960 | Morrison et al. | 271/225 |
| 3,647,045 | 3/1972 | Wegener | 414/54 |
| 3,994,487 | 11/1976 | Wicklund | 271/314 |
| 3,998,329 | 12/1976 | Araya et al. | 271/314 |
| 4,370,052 | 1/1983 | Murakami et al. | 271/288 |
| 4,480,825 | 11/1984 | Landa | 414/54 |

FOREIGN PATENT DOCUMENTS

| | | | |
|---|---|---|---|
| 1256289 | 12/1971 | United Kingdom | 271/314 |

*Primary Examiner*—George E. A. Halvosa
*Assistant Examiner*—James E. Barlow
*Attorney, Agent, or Firm*—Guy W. Shoup

[57] ABSTRACT

Sheets selective loading apparatus making groups of a given number of sheets discharged on a sheet stacker from sheet discharge rollers in an image recording apparatus and selectively loading the groups of sheets one on top of another alternatively on positions offset from each other. The sheet discharge rollers are movably held by a given distance in their axial direction. Sensors are provided to detect the trailing edge of sheets leaving respectively sheet-carrying rollers right upstream of the sheet discharge rollers, and the sheet discharge rollers. Control is so programmed in discharging a sheet to be stacked on a position offset from the normal position, that the sheet discharge rollers are moved lengthwise by the given distance after the trailing edge of sheet has been detected leaving the sheet-carrying rollers right upstream of the sheet discharge rollers, and returned to the original position after the trailing edge of sheet has been detected leaving the sheet discharge rollers and before the leading edge of the following sheet reaches the sheet discharge rollers.

3 Claims, 12 Drawing Figures

SELECTIVE SHEET LOADING APPARATUS

FIELD OF THE INVENTION AND RELATED ART STATEMENT

The present invention relates to a sheets selective loading apparatus which separates sheets continuously discharged from an image recording apparatus into groups of a given number of sheets, and selectively loads them alternatively in a staggered manner on a sheets stacker.

When two or more sets of recorded sheets, each of which is to be assembled by two or more sheets, are continuously discharged from an image recording apparatus such as a printer or a copying machine, or when the first page of a text is successively copied in given number of sets and then succesive pages are continually copied page by page in the same way to make a given number of sets, if sheets continuously discharged can be automatically separated into groups of a given number of sheets and selectively loaded alternatively in a staggered way on a sheet stacker, it is convenient and desirable because of the elimination of the need for some one's attendance to care for separating a pile of sheets into a given number of sets of a printed matter.

For this objective is well known a device in which the paper stacker itself can be moved to the right and left at right angles with the direction of paper discharge, and every time when a set of a given number of sheets is stacked on the stacker, the stacker is moved to the right or the left so that every sets of sheets are alternatively stacked on the left and right sides. In this connection, an eccentric cam, etc may be often used to move the paper stacker. Another device is also well known in which the paper stacker is swung to the right and the left by an angle on the stacker plane so that every sets of sheets are stacked alternatively offset by the angle. Other than those above, a further device is proposed in which two or more stackers are provided so that an alternative stacker is brought to the outlet of sheets, by turns, each time when a set of a given number of sheets has been discharged.

With the devices mentioned above, either has to move the stacker with sheets stacked on, thus having drawbacks that the device is extremely complex and big.

OBJECT AND SUMMARY OF THE INVENTION

The object of the invention is to provide a sheets selective loading apparatus with a simple configuration which eliminates the above-mentioned drawbacks of the prior art and can positively group and selectively load in proper positions sheets discharged from an image recording apparatus.

To achieve the object, according to the invention a pair of sheet discharge rollers in an image recording apparatus are movably held by a distance in the axial direction (e.g., from the first position to the second position apart by the distance or vice versa), and comprises means which moves aforesaid pair of sheet discharge rollers between aforementioned two positions, first detection means which detects that the trailing edge of a sheet has left sheet-carrying means right upstream of the pair of sheet discharge rollers, second detection means which detects that the trailing edge of the sheet has left the pair of sheet discharge rollers, and a programmed control unit under the aegis of which a required arithmetic or logical process is performed in such a manner as follows:

(a) When sheets are to be piled in a normal position of sheets stacker, the pair of discharge rollers are held in either the first position or the second position while they receive and discharge the sheets: and (b) when sheets are to be piled in an offset position, first the pair of discharge rollers are held in either the first position or the second position to receive the sheet, and moved to the other position after the first detection means has detected the trailing edge of the sheet leaving, and kept discharging the sheet at the offset position, and then returned to the original position, after the second detection means has detected the trailing edge of the sheet leaving, and before the leading edge of the subsequent sheet reaches into said pair of sheet discharge rollers.

BRIEF DESCRIPTION OF DRAWINGS

In the accompanying drawings, there are shown illustrative embodiments of the invention from which these and other of its objectives, novel features, and advantages will be readily apparent.

In the drawings.

DETAILED DESCRIPTION OF THE PREFERRED EMBODIMENTS

Figure 1:
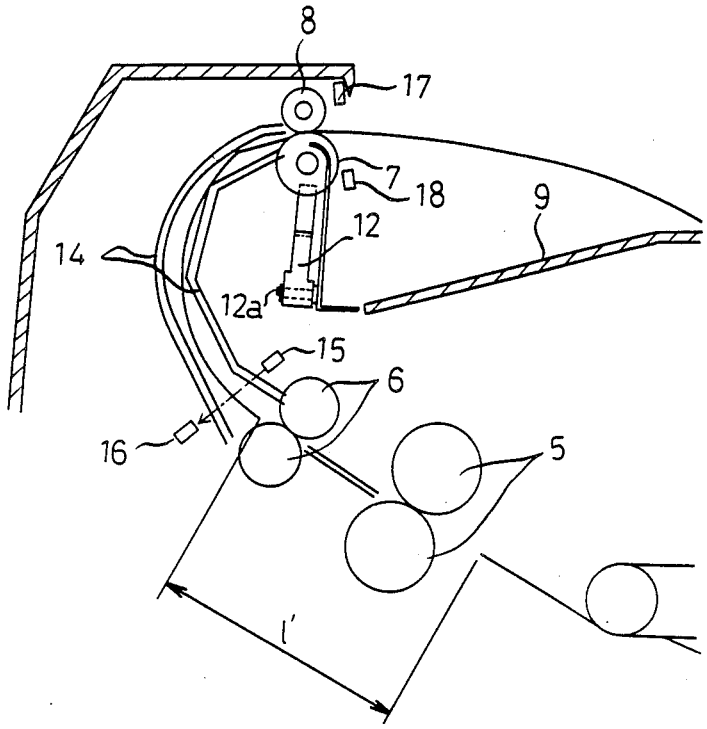
FIG. 1 is a sectional view in elevation of an embodiment according to the invention.
Figure 2:
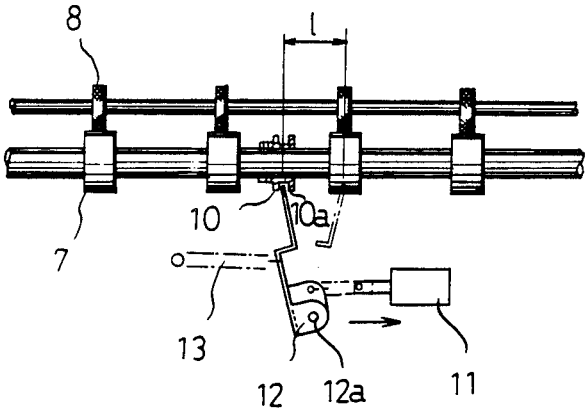
FIG. 2 is the front view of a pair of the sheet discharge rollers in FIG. 1.
Figure 4:
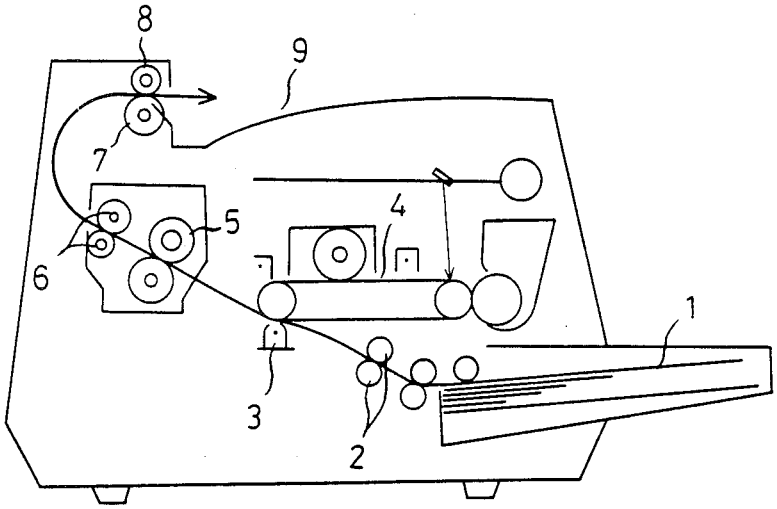
FIG. 4 is a sectional view in elevation showing a typical configuration of an image recording apparatus to which the invention is to be applied.

FIG. 4 shows the configuration of the well known laser printer, in which sheets fed out from a paper feed tray 1 are sent to a transfer section through feed rollers 2, where a toner image formed on a photosensitive belt 4 is transferred on a sheet by a transfer charger 3 and fixed by fixing rollers 5, and the sheet is discharged via fixed-sheet discharge rollers 6 and from pairs of sheet discharge rollers 7 and 8 on a sheets stacker 9 located on the top of the apparatus. The lower sheet discharge rollers 7 are driven from the fixing section through a chain, etc., and the upper sheet discharge rollers 8, which are respectively depressed down against the associated lower sheet discharge rollers 7, follow the associated lower sheet discharge rollers 7 through their own dead weight or a spring, etc. FIGS. 1 and 2 show a preferred embodiment according to the invention, applied to the laser printer in FIG. 4.

The lower roller 7 and the upper roller 8 of a pair of sheet discharge rollers are so supported with bearings provided in the image recording apparatus, that both can move lengthwise, and in an annular groove 10*a* on the outer surface of a collar 10 fixed on the shaft of lower rollers 7 engages a rocking plate 12 which is rotated about a fulcrum 12*a* by the action of a solenoid 11. When the solenoid 11 is not energized, the rocking plate 12 is pulled by a spring 13 to take a position shown by full lines in FIG. 2, anfd when the solenoid 11 is energized, the rocking plate 12 moves to another position shown by chain lines in the FIG. 2, whose upper end point travels a distance l in the axial direction of the rollers 7. When the rocking plate 12 moves to the position indicated by the chain lines, the lower rollers 7 move by a distance l via the collar 10 from the first position shown by the full lines to the second position shown by the chain lines the distance l apart in the axial direction in FIG. 3. The upper rollers 8 which are respectively depressed down against the associated lower rollers 7 follow the lower rollers 7 by friction to move the distance l in the same axial direction.

Figure 5:
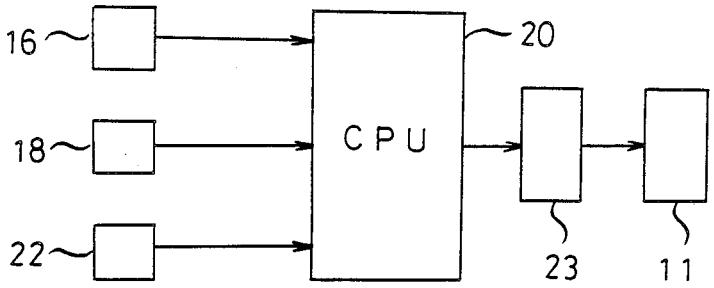
FIG. 5 is a block diagram showing arrangement of controls in use for a sheets selective loading apparatus according to the invention.

Near downstream of the fixed-sheet feed rollers, a sheet detection sensor consisting of a light emitting element 15 and a light detecting element 16 facing each other across a pair of sheet guides 14 is provided, and also downstream of the pair of discharge rollers 7 and 8, another sheet detection sensor consisting of another light emitting element 17 and another light detecting element 18 facing each other across a sheet outlet section is provided. An output of each of the light detecting elements 16 and 18 is input into CPU 20 as shown in FIG. 5, which receives also information from operational means 22 such as a recording-sheets-total-number set key, grouped-sheets-number set key, START key, etc. located on the panel of the recorder. To the output port of the CPU 22, a solenoid energizing circuit 23 is connected, which supplies aforesaid solenoid 11 with current. The CPU 20 counts the times of outputs from the light detecting element 18, which is compared with the number of sheets to be grouped that has been preset by the grouped-sheets-number set key, and, at the time when both have been the same, initiates control signals to direct a changeover of the travel modes of the sheet discharge rollers so that the other discharge position to the sheet stacker is taken from the previous one.

From now on, a typical operational procedure for grouping and selectively loading sheets according to an apparatus according to the invention is described.

Figure 3:
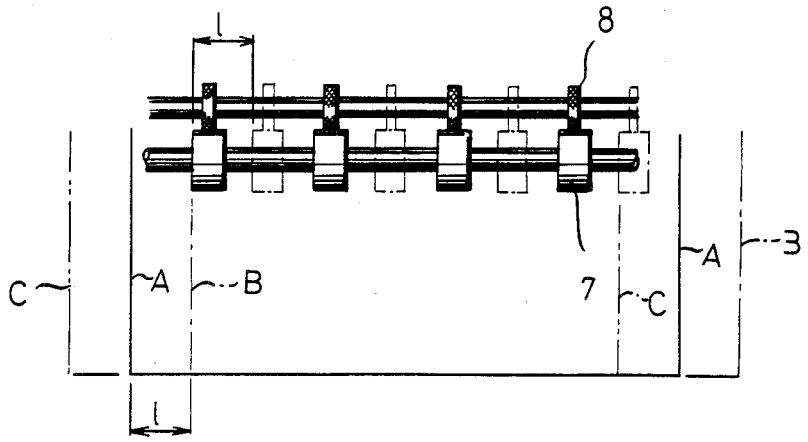
FIG. 3 is a pictorial representation showing their movement.

Usually, the sheet discharge rollers 7 and 8 are located at the first position shown by the full lines in FIG. 3, and sheets are discharged at the position shown by the full lines A. In grouping operation, when a control signal to direct discharging of sheets at an offset position distant from the aforesaid position A arrives, after the sensor 16 detects that the trailing edge of a sheet has passed through the fixed sheet discharge rollers 6 (the fixing rollers 5 if there are no fixed-sheet discharge rollers 6), the solenoid 11 is energized to move the sheet discharge rollers 7 and 8 via the rocking plate 12 to the second position shown by one-dot chain lines in FIG. 3, when, since the sheet is held only by the sheet discharge rollers 7 and 8, the sheet also moves to the right by the distance l along with the sheet discharged rollers 7 and 8, and then is discharged at the position B shown by the one-dot chain lines in the Figure, being placed down in a staggered way on the previous group of sheets already stacked at the position A. After the sheet detection sensor 18 detects that the trailing edge of the sheet has left the sheet discharge rollers 7 and 8, and before the leading edge of the subsequent sheet reaches the sheet discharge rollers 7 and 8 (before the subsequent sheet proceeds a distance l' shown in FIG. 1), the solenoid 11 is deenergized to remove the sheet discharged rollers 7 and 8 to the first position. The subsequent sheet is also discharged to the discharge position B in the same way as mentioned above, and this operation repetitively continues until a preset number of a group of sheets has been discharged.

Aforesaid control operation is achieved in the following way:

First a grouping mode is selected in the panel; information from operational means 22 such as the recording-sheets-total-number set key, the grouped-sheets-number set key, etc. is input into the CPU 22 as shown in FIG. 5; and recording is started by pressing down the START key; at this time this system is so controlled that, while discharging the first group of a given number of sheets, the sheets are received and discharged from the sheet discharge rollers 7 and 8 as they are maintained at the first position; and the CPU 20 counts the number of sheets detected by the sheet sensor 18 and compares it with the preset number of sheets to be grouped until both are equal to each other; then the solenoid 11 is so controlled that the following sheet is received by the sheet discharge rollers 7 and 8 at the first position and discharged at the second position; and aforesaid control is alternatively repeated for every given number of sheets to be grouped.

Figure 6:
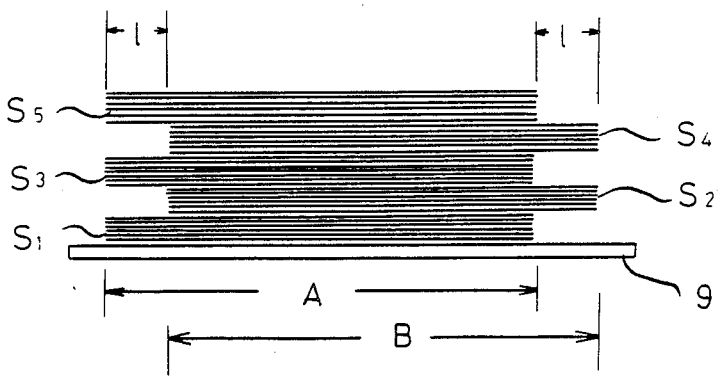
FIG. 6 is a front view showing a mode of sheets selective loading according to the invention.

As the result, on the sheet stacker 9, groups of sheets S1, S2, . . . . , which have been assembled into a given number of sheets, are stacked with one on top of another alternatively in a staggered manner offset by a distance l as shown in FIG. 6.

In this connection, in FIG. 3, if sheets are received at the sheet discharge rollers 7 and 8 as they are maintained at the second position as shown by the one-dot chain lines, and further if, after the trailing edge of the sheet has left the fixed-sheets discharge rollers 6, the sheet discharge rollers 7 and 8 are returned to the first position as shown by the full lines to discharge the sheet, the sheet can be discharged on the sheet stacker 9 at the position C shown by two-dot chain lines, offset by the distance l to the left from the position A.

Figure 7:
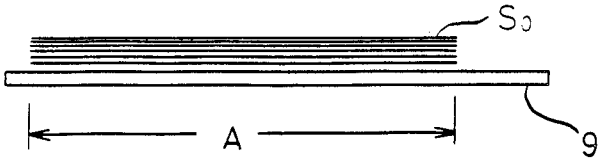
FIG. 7 is a front view of sheets stacked without selective loading.

In grouping and selectively loading sheets as mentioned above, the travel l of the sheet discharge rollers is equal to the offset of alternatively disposed groups of sheets. Therefore, an offset set larger to provide easier handling of grouped sheets necessitates a correspondingly large travel l of the sheet discharge rollers, thus resulting in a larger size of apparatus. In addition, when recorded sheets are stacked without being grouped on the sheet stacker, in other words with the sheet discharge rollers placed in a fixed position, sheets are stacked on the sheet stacker at the position A (or B) displaced to either side from the center of the stacker. (FIG. 7 shows the case of the position A.)

Next, a second embodiment according to the invention will be described, which provides such operational control that the offset of groups of sheets disposed one on top of another alternatively in a staggered way is larger than the travel of the sheet discharge rollers, and that sheets without being grouped are stacked on the center of the sheet stacker.

There are no differences in mechanical construction between this second embodiment and the previous embodiment in FIGS. 1 to 3, but for how to control.

Sheets are to be successively grouped into a given number of sheets and disposed one on top of another alternatively in a staggered manner on the two removed positions of the sheet stacker. In this embodiment, one-side groups of sheets stacked on are received by the sheet discharge rollers 7 and 8 as they are maintained at the first position as shown by the full lines in FIG. 3, and discharged at the second position as shown by the chain lines, thereby allowing the groups of sheets to be discharged and stacked at the position B on the sheet stacker 9; and the other-side groups of sheets stacked on are received by the sheet discharge rollers 7 and 8 as they are maintained at the second position, and discharged at the first position, thereby controlling so as to allow the groups of sheets to be discharged at the position C on the sheet stacker 9.

Figure 8:
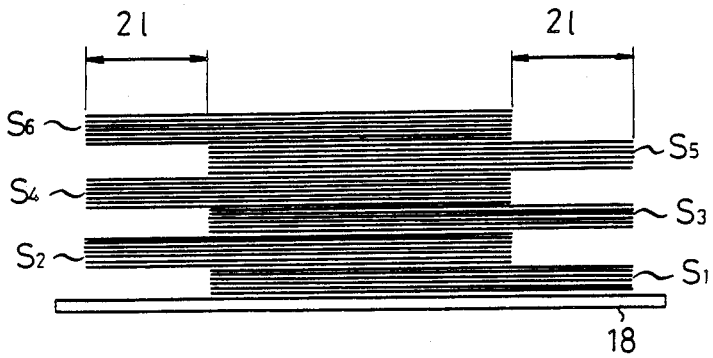
FIG. 8 is a front view showing another mode of sheets selective loading according to the invention.

As the result, on the sheet stacker 9, groups of sheets S1, S2, . . . . . , which have been respectively assembled into a given number of sheets to be grouped are alternatively stacked at two positions apart two times the distance l as shown in FIG. 8.

Figure 9:
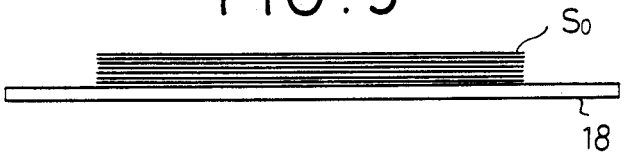
FIG. 9 is a front view of sheets stacked in an alternate position without selective loading.

And, maintaining the position of the sheet discharge rollers 7 and 8 at a fixed position while receiving and discharging sheets provides loading of sheets S0 on the center of the sheet stacker as shown in FIG. 9.

Furthermore, a control operation to discharge groups of sheets respectively assembled into a given number of sheets, successively at the position B, A, C, B, . . . . , provides three-tiered selective loading of groups of sheets.

Figure 10A:
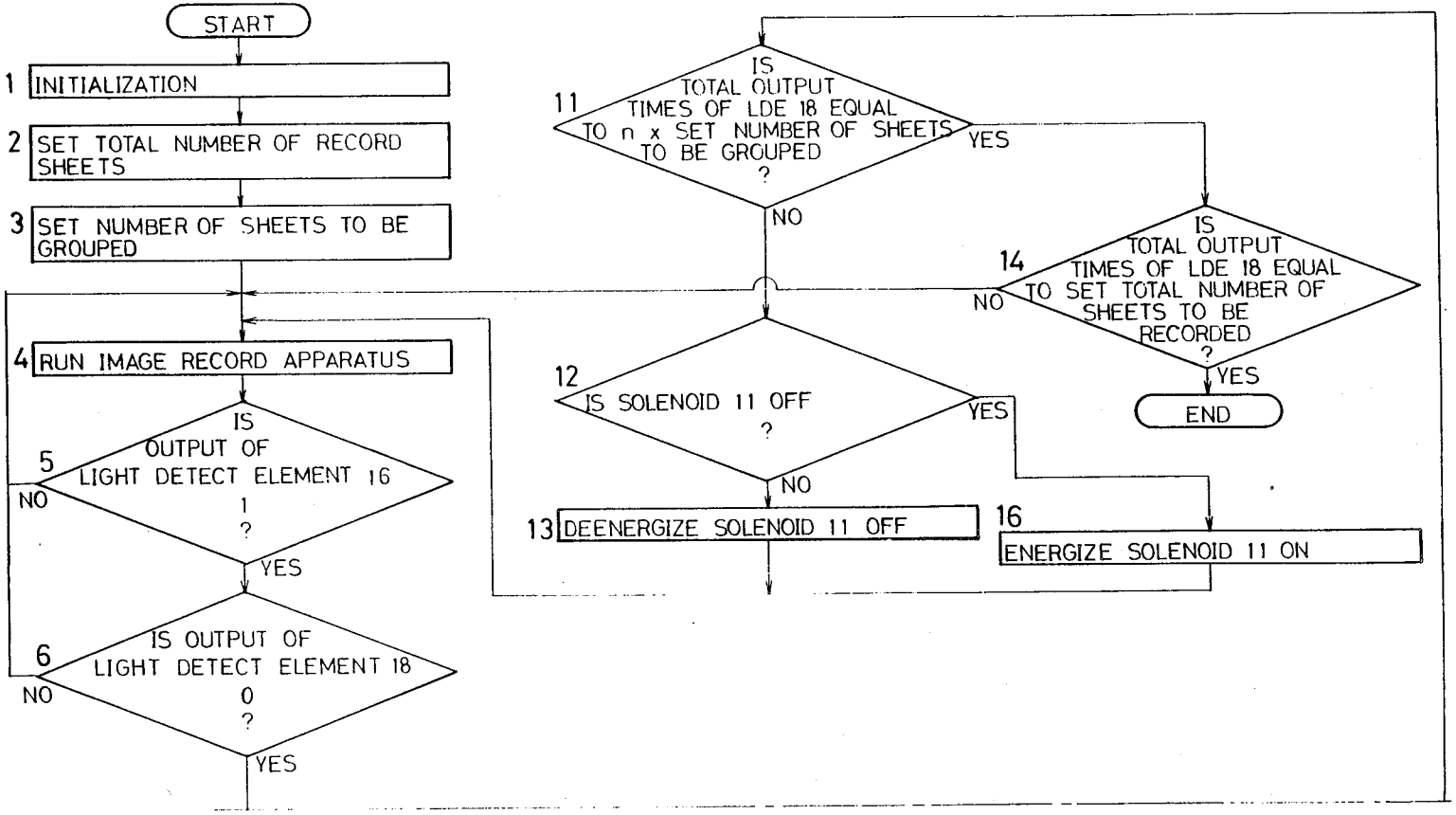
FIGS. 10*a* and *b* constitute a flow chart representing control operations of a sheets selective loading apparatus according to the invention.
Figure 10B:
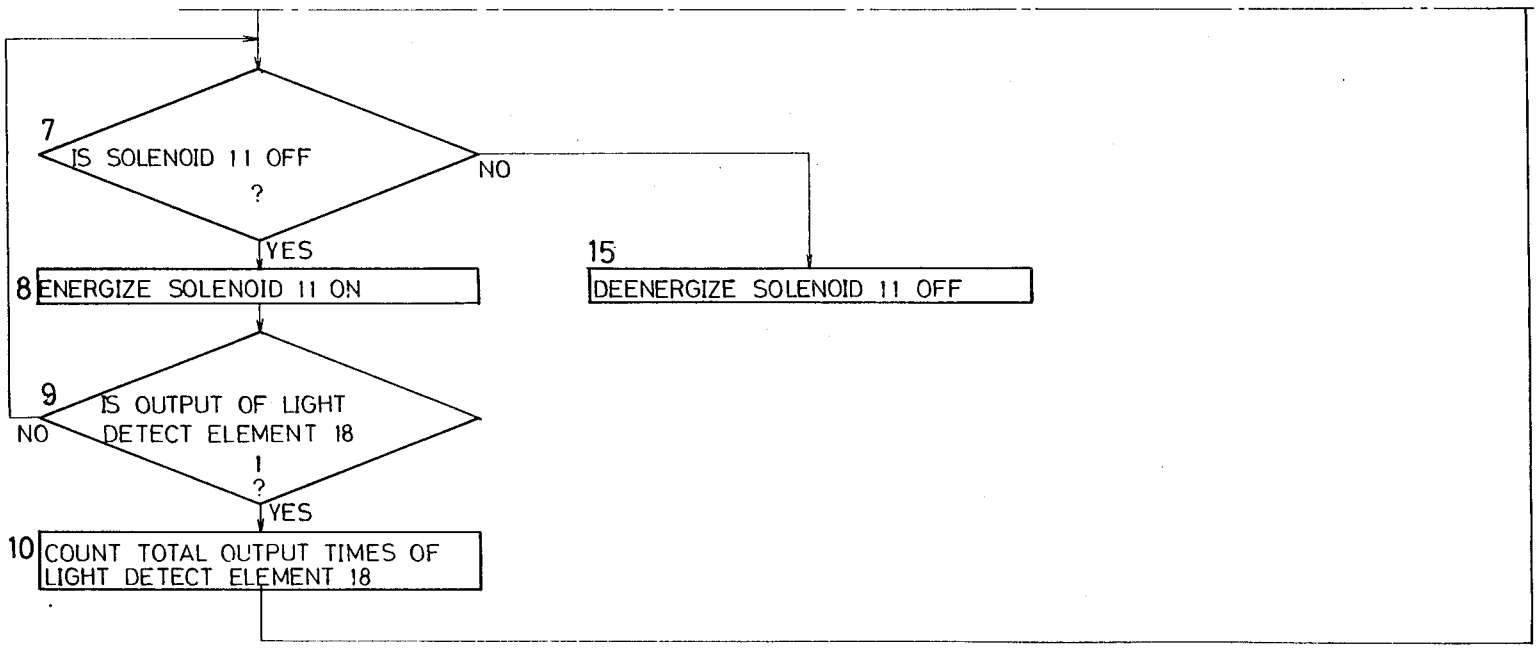

Next, the particular operations taken by a sheets selective loading apparatus according to the invention is explained, using the second embodiment abovementioned, referring to the flow chart in FIG. 10.

When an ON signal of the START key is transmitted to the CPU 20, a program loaded in the ROM in the CPU 20 starts to carry out the sequential operations of the sheets selective loading apparatus as shown in the flow chart in FIG. 10.

First, STEP (1) initializes an image recording apparatus shown in FIG. 4. Next STEPs (2) and (3) set a total number of sheets to be image recorded and a given number of sheets to be grouped by a recording-sheets-total-number set key, a grouped-sheets-number set key, and ten keys arranged on a control panel (not shown.) STEP (4) depresses a PRINT key (not shown) to operate aforementioned image recording apparatus for recording an image on the first sheet S1. Then, STEP (5) checks by the presence or absence of the output of the light detecting element 16 if the trailing edge of the first sheet S1 has left the fixed-sheet discharge rollers 6, when the output of the light detecting element 16 changes from a 0 to a 1. Further, when STEP (6) changes the output of the light detecting element 18 from a 1 to a 0, right after the leading edge of the first sheet S1 has been inserted into the sheet discharging rollers 7 and 8, STEP (7) identifies an OFF state of the solenoid 11. Since the solenoid 11 has been gone OFF at STEP (1), STEP (8) energizes the solenoid 11 to ON, when, via the rocking plate 12, the sheet discharging rollers 7 and 8 are moved by a distance (l) from the first position (shown by the full lines as shown in FIG. 3) toward the second position (shown by the chain lines), thereby allowing the first sheet S1 to be displaced by the distance (l) toward the right direction in FIG. 3 while being held by the sheet discharging rollers 7 and 8.

Next, when the trailing edge of the first sheet S1 being discharged at the second position is loaded on the sheet stacker 9, and STEP (9) changes the output of the light detecting element 18 from a 0 to a 1, STEP (10) counts the number of sheets which have passed between the light emitting element 17 and the light detecting element 18, or the total times of outputs of the light detecting element 18. Then, STEP (11) identifies that the total times of the outputs of the light detecting element 18 counted at STEP (10) are equal or not equal to n×the number of sheets to be grouped set at STEP (3), where n is 1 as the initial value and is added by 1 each time a grouping of sheets is completed. If STEP (11) identifies that the total times of the outputs of the light detecting element 18 are not equal to n×the set number of sheets to be grouped (here, n=1), STEP (12) checks if the solenoid 11 remains OFF. But, since STEP (8) has energized the solenoid 11 to ON, a control signal goes to STEP (13), which deenergizes the solenoid 11 to OFF. An OFF state of the solenoid 11 deenergized at STEP (13) allows the sheet discharge rollers 7 and 8 to return toward aforesaid first (home) position to pick up the first sheet S1, or toward the left direction in FIG. 3, before a control signal returns to STEP (4). A cyclic repetition of the aforementioned operations from STEP (4) through STEP (13) permits successive image-recorded sheets of the first group of sheets S1 to be progressively discharged on the sheet stacker 9 at the position B shown by the one-dot chain lines in FIG. 3. In this way, for instance as shown in FIG. 8, the first group of sheets S1 representing the lowest loaded group of sheets is discharged and piled at the position B on the sheet stacker 9.

Next, when STEP (11) identifies that the total times of the outputs of the light detecting element 18 equal n×the set number of sheets to be grouped (here, n=1), STEP (14) examines if the total times of the outputs of the light detecting element 18 equal the preset total number of sheets to be recorded. If STEP (14) identifies that the total times of the outputs of the light detecting element 18 are not equal to the preset total number of sheets to be recorded, a control signal returns to STEP (4), and then a sheet of the second group of sheets S2 to be grouped is held out from the sheet discharge rollers 7 and 8, thus causing STEP (6) to deenergize the light detecting element 18 from a 1 to a 0, when, since STEP (8) has triggered and left the solenoid 11 ON, the second position shown by the chain lines in FIG. 3 becomes the new home position of the sheet discharge rollers 7 and 8 to pick up recorded sheets of the second group of sheets S2. Therefore, while the recorded sheets of said second group of sheets S2 are held between the sheet discharge rollers 7 and 8, STEP (7) identifies that the solenoid 11 is OFF, causing a control signal to go to STEP (15), which deenergizes the solenoid 11 to OFF. After STEP (15) has deenergized the solenoid 11 to OFF, the sheet discharge rollers 7 and 8 are moved toward the first position (represented by the full lines) from the second position (represented by chain lines), thus permitting the sheets of the second group of sheets S2 picked up by the sheet discharge rllers 7 and 8 to be discharged on the sheet stacker 9 at the position C shown by the two-dot chain lines on the side of the first position in FIg.3. Next, as with the case of said first group of sheets S1, cyclic operations starting from STEP (9) and ending to STEP (12) are carried out, when, if STEP (11) identifies that the total output times of the light detecting element 18 are not equal to n×the preset number of sheets to be grouped (here, n=2), STEP (12) checks if the solenoid 11 is OFF. In this case, since STEP (15) has deenergized the solenoid 11 to OFF, the signal goes to STEP (16), which triggers the solenoid 11 to ON. An ON state of the solenoid 11 at STEP (15) causes the sheet discharge rollers 7 and 8 to move toward said second (home) position to pick up the sheets of the second group of sheets S2, or in the right direction in FIG. 3, and then the signal returns to STEP (4), which, as with the case in the first group of sheets S1, a cyclic repetition of the following operations, starting from STEP (4) and going in sequence to STEP (5), STEP (6), STEP (7), STEP (15), STEP (9), STEP (10), STEP (11), and STEP (12), and ending in STEP (16), allows following sheets of the second group of sheets S2 to be successively discharged at the first position of the sheet discharge rollers 7 and 8 or on the sheet stacker 9 at the position C as shown by the two-dot chain lines in FIG. 3. In this manner, as shown in FIG. 8, the sheets of the second group of sheets S2 representing the group of sheets to be secondly stacked are discharged and piled on the sheet stacker 9 at the position a distance 2×l apart from that of the first loaded group of sheets S1.

And, if STEP (11) identifies that the total output times of the light detecting element 18 fall in with n×the given number of sheets to be grouped (here, n=2), STEP (14) checks if the total output times of the light detecting element 18 equal the total preset number of sheets to be recorded. If it is not the case, the control signal returns to STEP (4), and sheets of the third group of sheets S3 to be grouped are successively picked up by the sheet discharge rollers 7 and 8, thus causing the output of the light detecting element 18 to go from a 1 to a 0 at STEP (6), when, since STEP (15) has left the solenoid 11 OFF, as with the case of the first group of sheets S1, the first position shown by the full lines in FIG. 3 becomes the home position for the sheet discharge rollers 7 and 8 picking up the sheets of the third group of sheets S3. Therefore, when each of the sheets of the third group of sheets S3 is held between the sheet discharge rollers 7 and 8, STEP (7) judges the solenoid 11 OFF, STEP (8) effectively energizes the solenoid 11 to ON as with the case of the first group of sheets S1. Successive operations are carried out all the same way as with the first group of sheets S1, thus allowing each of the sheets of the third group of sheets S3 to be successively discharged on the side of the second position for the sheet discharge rollers 7 and 8 or at the position B on the sheet stacker 9 in FIG. 3, resulting in the third group of sheets S3 corresponding to the group of sheets to be piled in the third row from the bottom to be discharged and stacked on the sheet stacker 9 at the position a distance of 2×l apart to the right from the second group of sheets S2 or exactly over the position of the first group of sheets S1, as shown in FIG. 8.

Following operations for the fourth group of sheets S4, the fifth group of sheets S5, and so on are carried out as previously mentioned in accordance with the program depicted in the flow chart in FIG. 10, thus allowing groups of a given number of sheets S1, S2, S3, . . . to be respectively discharged and piled one on top of another alternatively a distance (2×l) apart from each other in a staggered manner, and come to a halt when STEP (14) identifies the total output times of the light detecting element 18 equal to the preset total number of recording sheets.

On the other hand, when image recorded sheets S are not to be grouped and selectively stacked, aforesaid program is not run, thus allowing sheets S0 to be discharged on the sheet stacker 9 without any movement of the sheet discharge rollers 7 and 8. Therefore, the sheets S0 proceed along the sheet guide 14, regardless of the position of the sheet discharge rollers 7 and 8, and are discharged on the sheet stacker 9 at the position A as shown by the full lines in FIG. 3 or in the center between the positions of the first group of sheets S1 and the second group of sheets S2 to be grouped and selectively stacked, thus resulting in the shift of this sheets S0 from the other first group of sheets S1 and from the other second group of sheets S2 to be the travel of the sheet discharge rollers 7 and 8 or the distance l between the first and second positions. As mentioned above, said sheets selective loading apparatus provides the first group of sheets S1 and the second group of sheets S2 to be selectively loaded with a shift two times the travel of the sheet discharge rollers 7 and 8, thereby becoming smaller than the prior art with respect to a desired shift, or becoming two times larger in shift with respect to a given travel of the sheet discharge rollers 7 and 8, thus ensuring easy and positive separation of groups of sheets.

Figure 11:
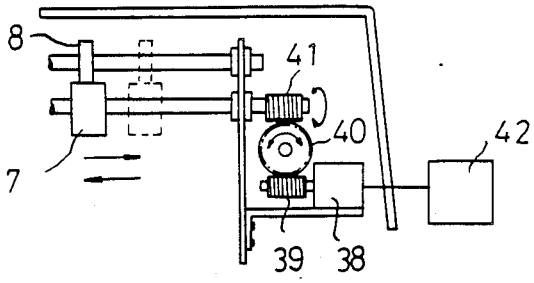
FIG. 11 is a front view of main portions showing another embodiment of a sheets selective loading apparatus according to the invention.

In addition, the above-mentioned sheets selective loading apparatus according to the invention embodied an example in which a pair of sheet discharge rollers is moved by a solenoid. Means travelling the pair of sheet discharge rollers is not limited to the solenoid, but a pair of sheet discharge rollers may be moved, for example as shown in FIG. 11, by a combination of reversible motor 38, worm 39, worm gear 40 and another worm gear 41, provided that aforementioned motor 38 is connected to the CPU 20 through motor drive circuit 42, and that, with the case of aforesaid second embodiment, in the programming flow in FIG. 10, STEPs (7) and (12) identify that the motor 38 is running in reverse, STEPs (8) and (16) throw the motor into NORMAL ROTATION, and STEPs (13) and (15) into REVERSE ROTATION.

As described above in detail, the invention provides a simple configuration in which sheets continuously discharged from an image recording apparatus can be positively and easily grouped, selectively loaded and separated into groups of sheets in preset number of grouped sheets and of groups. Furthermore, there is a good selection of control patterns in which a shift of alternatively loaded groups of sheets can be made larger than a travel of a pair of sheet discharge rollers, or sheets not to be grouped can be stacked in the center of the sheet stacker.

What is claimed is:

1. A sheet selective loading apparatus which make groups a given number of sheets discharged on a sheet stacker from a pair of sheet discharge rollers in an image recording apparatus and selectively loads said groups of sheets alternatively on positions separate from each other one on top of another, wherein said pair of sheet discharge rollers are held movably in their axial direction between first and second positions a given distance apart from each other, and comprising means to move said pair of sheet discharge rollers between said two positions;

first detecting means to detect that the trailing edge of sheets has left sheet-carrying means upstream of said pair of sheet discharge rollers;

second detecting means to detect that the trailing edge of sheets has left said pair of sheet discharge rollers ; and control means which when sheets are to be discharged in a normal position on said sheet stacker, is so programmed that said pair of sheet discharge rollers are held at either said first or second position while they receive and discharge the sheets, and when sheets are to be discharged in another position offset from said normal position, is so programmed that said sheet discharge rollers are held at either said first or second position, said pair of sheet discharge rollers are moved to the other position after said first detecting means has detected the trailing edge of sheets to be discharged at the other position, and are returned to the original position in response to said second detecting means detecting the trailing edge of said sheets and before the leading edge of the following sheet reaches said pair of sheet discharge rollers.

2. A sheet loading apparatus as claimed in claim 1, further comprising control means which is so programmed that sheets are grouped into two or more sets each having a given number of sheets and stacked on said sheet stacker alternatively on said normal and offset positions.

3. A sheet loading apparatus as claimed in claim 1, further comprising control means which is so programmed that one group of sheets is received by said pair of sheet discharge rollers as they are held at said first position, and said pair of sheet discharge rollers is moved to said second position before discharging said group of sheets on said sheet stacker; and the other group of sheets is received by said pair of sheet discharge rollers as they are held at said second position, and said pair of sheet discharge rollers is moved to said first position before discharging said other group of sheets on said sheet stacker.

* * * * *